US005569063A

United States Patent [19]

Morioka et al.

[11] Patent Number: 5,569,063

[45] Date of Patent: Oct. 29, 1996

[54] POLISHING APPARATUS

[75] Inventors: Izuru Morioka; Kenji Kuwano, both of Tokyo, Japan

[73] Assignee: Nihon Micro Coating Co., Ltd., Japan

[21] Appl. No.: 499,286

[22] Filed: Jul. 6, 1995

[30] Foreign Application Priority Data

Aug. 5, 1994 [JP] Japan ..... 6-203008

[51] Int. Cl.[6] ..... B24B 21/00

[52] U.S. Cl. ..... 451/296; 451/303; 451/310; 451/388

[58] Field of Search ..... 451/168, 169, 451/296, 303, 310, 388

[56] References Cited

U.S. PATENT DOCUMENTS

| | | | |
|---|---|---|---|
| 3,524,284 | 8/1970 | Means | 451/303 |
| 4,213,698 | 7/1980 | Firtion et al. | 451/388 |
| 4,567,938 | 2/1986 | Turner | 451/388 |
| 5,193,314 | 3/1993 | Wormley et al. | 451/296 |
| 5,245,792 | 9/1993 | Liechti et al. | 451/310 |

FOREIGN PATENT DOCUMENTS

| | | | |
|---|---|---|---|
| 6198554 | 7/1994 | Japan | 451/296 |

*Primary Examiner*—D. S. Meislin
*Assistant Examiner*—Eileen P. Morgan
*Attorney, Agent, or Firm*—Majestic, Parsons, Siebert & Hsue

[57] ABSTRACT

A polishing apparatus, for polishing/cleaning a target object surface by using a polishing tape, has a spindle rotatably placed inside an opening formed in a base plate, a motor for rotating the spindle, a compression roller rotatably supported between a pair of side walls attached to the spindle, supply and take-up rollers supported rotatably by the side walls for advancing the polishing tape, and a motor for the take-up roller. The polishing tape is supplied from the supply roller and taken up by the take-up roller through the compression roller, while rotating around with the spindle. The compression roller has a smaller diameter at its center part than at its end parts for preventing the polishing tape from becoming twisted or wrinkled when the compression roller is rotated by the motion of the spindle while being pressed against a target object and being advanced from the supply roller to the take-up roller.

20 Claims, 8 Drawing Sheets

POLISHING APPARATUS

BACKGROUND OF THE INVENTION

This invention relates to a polishing apparatus for polishing and/or cleaning a planar surface by means of a polishing (or abrasive) tape adapted not only to travel longitudinally but also to undergo a rotary motion in a plane parallel to the surface to be polished. More particularly, this invention relates to such a polishing apparatus capable of polishing and/or cleaning not only flat surfaces such as surfaces of glass plates for liquid crystal devices and printed circuit boards but also surfaces of elastic curved plates such as window panes of an airplane.

Liquid crystal devices are currently being used extensively in a variety of fields of application. Liquid crystal display devices, in particular, are commonly used in many word processors, personal computers and televisions. Such a liquid crystal device is produced by carrying out various processes on glass plates such as cutting, injecting liquid crystal and attaching a polarization plate. During the course of such a production process, glass powder is usually generated copiously as glass plates are cut and liquid crystal is injected and sealed, and residual resin materials used for the sealing appear as a contaminant. It is well known that such a contaminant is a major cause of the occurrence of defective products. Prior art methods of removing such contaminants have been manual, however, using a cutting knife or a solvent such as acetone or alcohol. Manual methods of removing contaminants affect the production efficiency adversely, and it is difficult to maintain a uniform level of product quality.

In electronic devices such as word processors and personal computers, it is common to use a printed circuit board with wires formed thereon for attaching elements such as semiconductor chips. Production of such a printed circuit board includes both chemical processes such as the formation and removal of thin films and physical processes such as punching holes and cutting in order to form connecting wires. For this purpose, it is necessary to polish both the front surface and the back surface of a base plate. Prior art methods of polishing, however, included using an endless belt, etching, sand blasting and buffing, but the use of a polishing tape is becoming popular because tapes are not only capable of accomplishing desired polishing but also easy to handle.

Another problem to be solved by the present invention relates to the polishing of a plate with a curved surface. Front windows of an airplane, for example, are curved for the purpose of their use, and their surfaces are usually polished to remove scratches and/or cleaned manually by means of a hand-polisher. Manual polishing and/or cleaning operations are inefficient, and their results are not uniform, depending upon the operator who handles the polisher.

SUMMARY OF THE INVENTION

It is therefore an object of this invention to provide an automated polishing apparatus for polishing and/or cleaning a planar surface by using a polishing tape.

It is another object of this invention to provide such a polishing apparatus capable of uniform polishing and/or cleaning.

It is still another object of this invention to provide such a polishing apparatus capable of efficient polishing and/or cleaning.

It is still another object of this invention to provide such a polishing apparatus capable also of polishing and/or cleaning elastic plate with a convex surface.

A polishing apparatus embodying the present invention, with which the above and other objects can be accomplished, may be characterized as comprising a base plate having an opening therethrough, a spindle rotatably contained in this opening, a first rotating means attached to the base plate for rotating the spindle, a pair of side walls attached to the spindle, a compression roller for pressing a polishing tape against a target object, the compression roller being rotatably attached between the side walls, having a rotary shaft which is perpendicular to the axis of the spindle, and having a center part with a smaller diameter than end parts which sandwich the center part, tape-advancing rollers including a supply roller and a take-up roller both having a rotary shaft which is parallel to the rotary shaft of the compression roller and rotatably supported by the side walls, the supply roller serving to supply the polishing tape and the take-up roller serving to take up the polishing tape supplied from the supply roller, and a second rotating means attached to the spindle for rotating the take-up roller.

It is preferred that the compression roller be so designed that its center and end parts are each about one-third of the length of the compression roller. It is also preferred that the apparatus additionally includes a table for placing the target object thereon, being placed opposite to the compression roller and movable within a plane which is perpendicular to the axial direction of the spindle, and a shifting means for moving the table. It is further preferred that the apparatus still additionally comprises a frame and an attaching means for attaching the base plate to the frame slidably in the axial direction of the spindle, the attaching means including means for moving the base plate and thereby placing the compression roller at a specified position. It is still further preferred that the table has an indentation formed thereon for containing the target object therein, the indentation being adapted to be connected to a vacuum source. The table, according to a preferred embodiment, has at least one pin-containing hole which opens to the indentation and contains a pin therein, the pin being capable of pushing the target object out of the indentation. Such apparatus are particularly suited for the polishing and/or cleaning liquid crystal substrates and printed circuit boards. The table would preferably also include an elastic member provided inside and around the indentation. Such a table is particularly suited for the polishing and/or cleaning of an elastic target object having a convex surface such as front window panes of an airplane.

Because use is made of a polishing tape which advances longitudinally, the target object is always contacted with a fresh surface of the tape. Since the polishing tape is rotated, furthermore, the polishing and cleaning processes can be effected efficiently. Since the compression roller is designed to have a smaller diameter in its center part, the polishing tape is not twisted or wrinkled although it is rotated as it is used against a target object. Since the target object is placed on a two-dimensionally movable table, the polishing tape can be contacted all over the target object. Since the polishing apparatus according to this invention is provided with means for moving vertically with respect to the table, the polishing tape can be pressed against the target object with a specified pressure. The target object is fastened to the table by producing a negative pressure condition inside an indentation formed on the table. Since an elastic packing material is placed inside the indentation, a target object with a curved surface can be flattened inside the indentation when it is polished and/or cleaned.

BRIEF DESCRIPTION OF THE DRAWINGS

The accompanying drawings, which are incorporated in and form a part of this specification, illustrate an embodiment of the invention and, together with the description, serve to explain the principles of the invention. In the drawings.

DETAILED DESCRIPTION OF THE INVENTION

Figure 1:
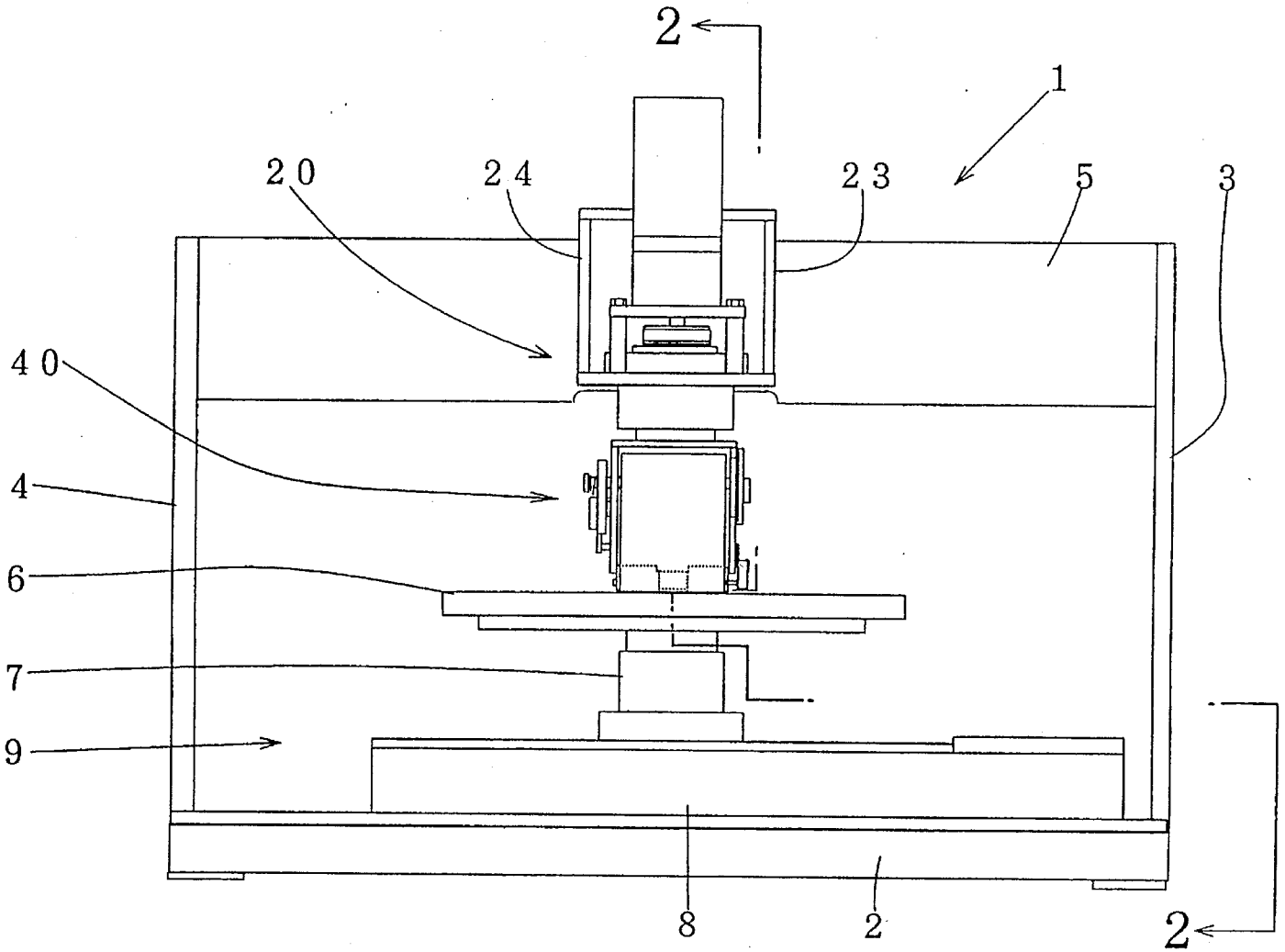
FIG. 1 is a front view of a polishing apparatus embodying this invention.
Figure 2:
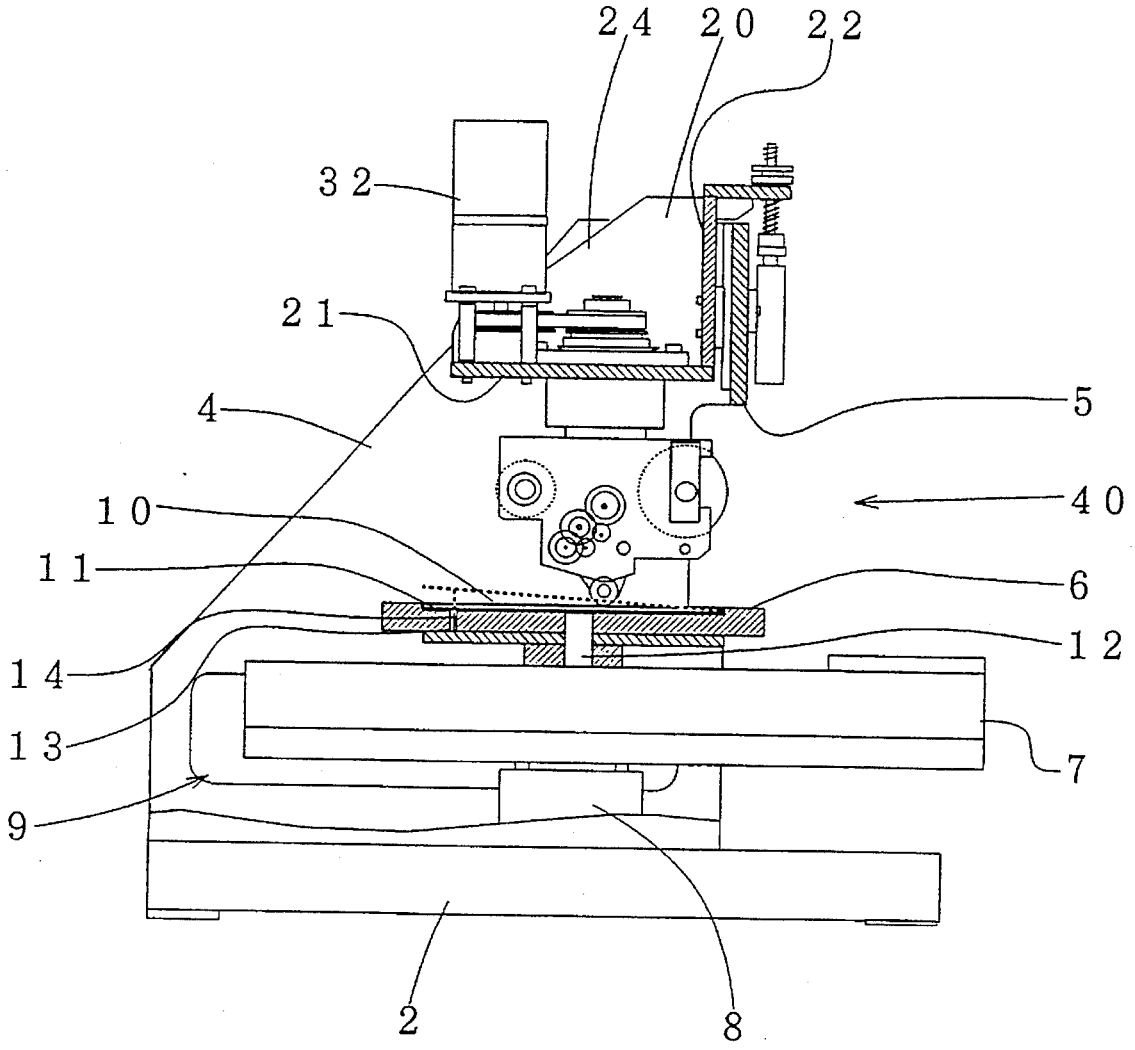
FIG. 2 is a partially sectional side view of the apparatus of FIG. 1 taken along line 2—2 in FIG. 1.

As shown in FIG. 1, a polishing apparatus 1 according to this invention has vertical side walls 3 and 4 perpendicularly attached to ends of a base 2, and a vertically oriented frame 5 extended horizontally between the side walls 3 and 4. As shown in FIG. 2, which is a side view 0f the polishing apparatus 1, the side walls 3 and 4 are triangularly shaped for the convenience of its operator standing in front.

The base 2 also supports a shifting mechanism 9 for allowing a table 6 thereon to move two-dimensionally in a horizontal plane, comprising an X-shifter 8 and a Y-shifter 7, respectively for allowing the table 6 to move one-dimensionally along an X-direction (the left-right direction in FIG. 1) and a Y-direction (the left-right direction in FIG. 2). The X-shifter 8 is attached to the base 2 and serves to move the Y-shifter 7 disposed thereon in the X-direction in response to a control signal, causing the table 6 to move along the X-axis. Similarly, the Y-shifter 7 serves to move the table 6 thereon in the Y-direction in response to a control signal, such that the table 6 can be moved to any position within a horizontal plane by means of the shifting mechanism 9. Since such two-dimensional shifting mechanisms are well known, no further detailed description will be presented.

Above the table 6 is a tape-advancing mechanism 40 for causing a polishing tape to travel, attached to the frame 5 through an attachment device 20 (to be described in detail below) so as to be movable vertically. As shown in FIG. 2, the table 6 has an indentation 11 formed at its center such that a target object 10 in a planar form (to be polished and/or cleaned) can be contained therein with its top surface approximately flush with the top surface of the table 6. The indentation 11 is connected to a vacuum pump means (not shown) through a hole 12 such that the target object 10 can be affixed inside the indentation 11 securely when it is placed therein and the vacuum pump means is operated.

There is another hole 13 formed through the table 6, leading from the interior of the indentation 11. A vertically movable push-pin 14 is disposed inside the hole 13. When the target object 10 is set inside the indentation 11, the pin 14 is contained completely inside the hole 13. When the target object 10 is removed from the interior of the indentation 11, the pin 14 is caused to protrude upward from the hole 13 and to push the target object 10 upward, as shown by broken lines in FIG. 2, so as to make the removal of the target object 10 easier. Although a single pin suffices for the purpose, it is preferable to have two such pins.

Figure 3:
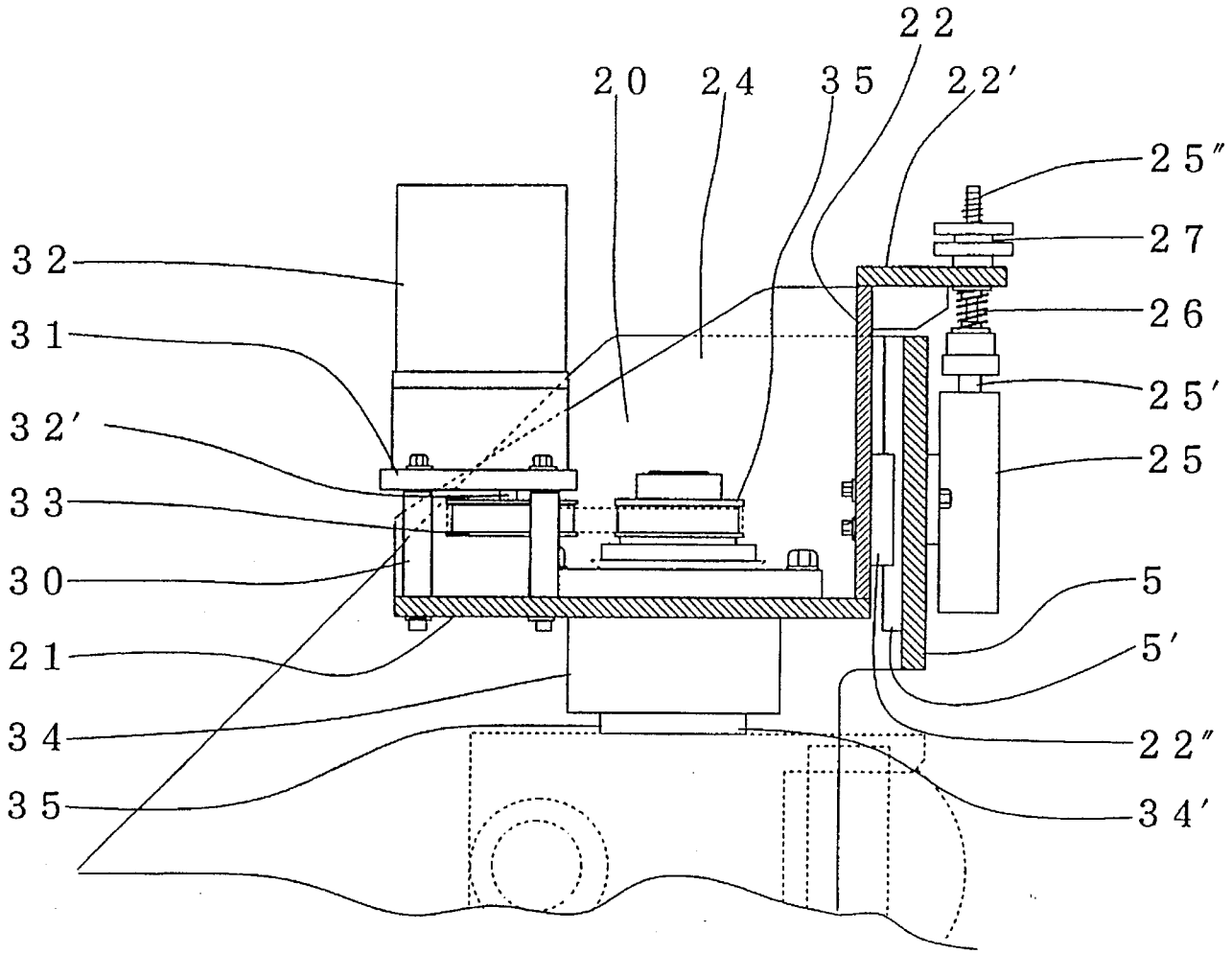
FIG. 3 is a portion of FIG. 2 showing details of the mechanism for vertically moving the attachment device.

The manner in which the attachment device 20 is fastened to the frame 5 is described next with reference to FIGS. 2 and 3. The attachment device 20 includes not only a base plate 21 and a back plate 22 which together form an L-shape, but also side plates 23 and 24 on both sides thereof. A vertically extending guide rail 5' is attached to the frame 5 behind the back plate 22. A slider 22', which is engageable with the guide rail 5' and slidable therealong, is attached to the back plate 22 such that the attachment device 20 can move only vertically with respect to the frame 5. Vertically disposed behind the frame 5 is a cylinder 25 from which a movable rod (or cylinder rod) 25' extends. The back plate 22 has a backwardly extended horizontal section 22', through which a bolt 25" is vertically supported. A spring 26 is provided around the bolt 25" between this extended section 22' and the cylinder rod 25'. The bolt 25" supports an adjusting knob 27. As this adjusting knob 27 is advanced along the bolt 25" against the elastic force of the spring 26, the extended section 22' is pushed downward, causing the attachment device 20 to move downward as a whole. If the cylinder 25 is of a type capable of accurately moving the attachment device 20 up and down, the extended section 22' and the cylinder rod 25" may be connected directly.

An attachment table 31 is attached through legs 30 to a front portion of the base plate 21 of the attachment device 20 parallel to the base plate 21. A spindle-rotating motors 32 is attached to this attachment table 31 with its rotary shaft 32' extending downward through a throughhole (not shown) formed through the attachment table 31 and having a pulley 33 attached to its lower end.

Figure 4:
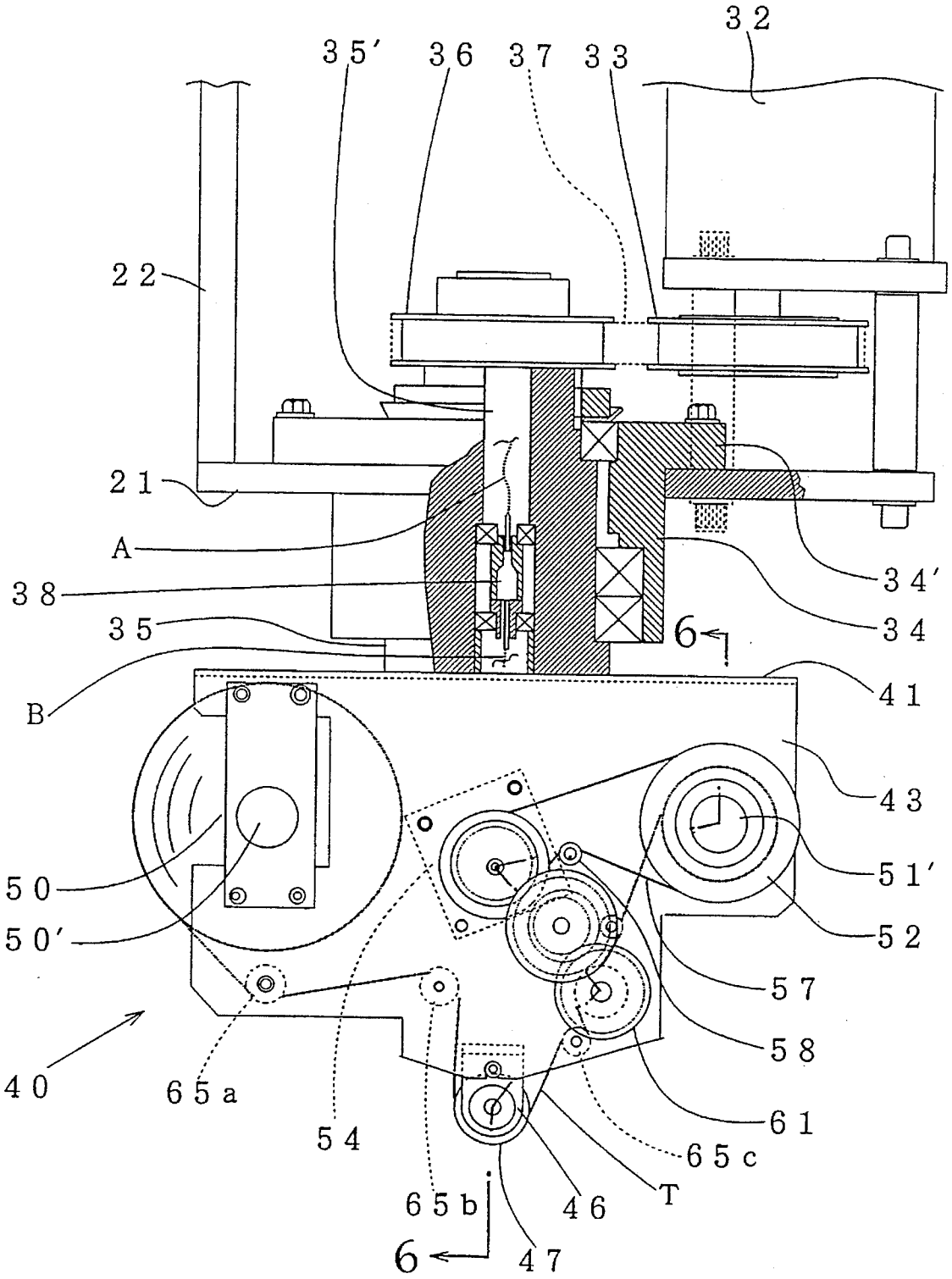
FIG. 4 is a sectional side view of a portion of the apparatus of FIG. 1 showing the mechanism for rotating its spindle and tape-advancing mechanism.

A circular opening is provided through the base plate 21 of the attachment device 20 at its center and, as shown in FIG. 4, a cylindrical member 34 of the same diameter is passed through this opening. The upper part of this cylindrical member 34 is in the form of a flange 34' radially protruding outward. The flange 34' is affixed to the base plate 21 by means of screws and in contact with the base plate 21 so as to prevent the cylindrical member 34 from slipping down through the opening in the base plate 21.

As shown further in detail in FIG. 4, the cylindrical member 34 is formed with an axially extending throughhole. A hollow tubular spindle 35 is disposed inside this throughhole, provided with bearings so as to be rotatable but prevented from falling off therefrom. Another pulley 36 is attached to the top end of the spindle 35. The other end of the spindle 35 is attached to the tape-advancing mechanism 40.

The two pulleys 33 and 36, respectively attached to the rotary shaft 32' of the motor 32 and the spindle 35, are connected by a belt 37 such that the rotary motion of the motor 32 is communicated through the belt 37 and that the spindle 35 is caused to rotate inside the cylindrical member 34. As a result, the tape-advancing mechanism 40 is also caused to rotate.

Although the rotary motion of the motor 32 is communicated to the spindle 35 through a belt according to the embodiment of the invention shown in FIG. 4, their connection may be accomplished through gears or similar means, for example, by forming the rotary shaft of the motor and the spindle unistructurally.

The throughhole through the spindle 35 contains therein a connector 38 which is rotatable with respect to the spindle 35. Two lead lines A and B are extended from both ends of the connector 38. Lead line A is affixed to the connector 38, but lead line B is rotatable with respect to the connector 38. The connector 38 serves to electrically connect the lead lines A and B. Lead line A is connected to a power source (not shown), and line B is connected to a tapeadvancing motor 54 on the tape-advancing mechanism 40. Thus, lead line A is not forced to rotate even if the spindle-rotating motor 32 is activated and both the tape-advancing motor 54 and lead line B are moved around the axis of the spindle 35.

Since lead lines A and B are electrically connected, furthermore, power can be transmitted to the tape-advancing motor 54 even while the tape-advancing motor 54 undergoes a rotary motion together with the tape-advancing mechanism 40. In other words, the tape-advancing motor 54 can be activated, independently of whether or not the spindle 35 and the tape-advancing mechanism 40 are rotating.

Figure 5:
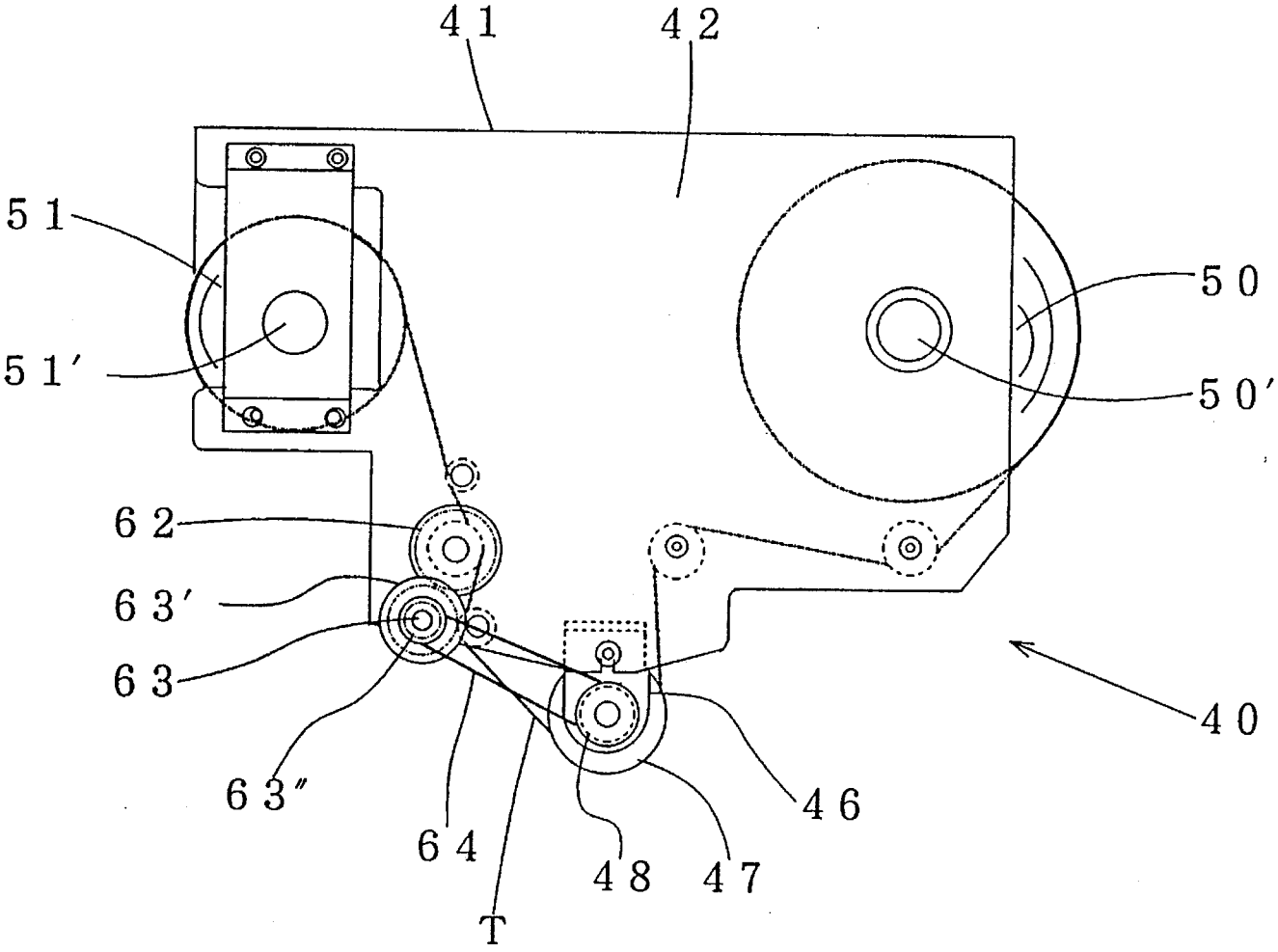
FIG. 5 is another side view of the tape-advancing mechanism.

Next, the structure of the tape-advancing mechanism 40 is described in detail with reference to FIGS. 4, 5 and 6.

The tape-advancing mechanism 40 comprises a top wall 41 to which the spindle 35 is affixed, and two side walls 42 and 43 extending parallel to each other from both its side edges. A sectionally U-shaped member 46 is attached to these side walls 42 and 43 near their bottoms. A compression roller 47 is rotatably supported by this U-shaped member 46 such that its rotary shaft 47' passes perpendicularly through the axis of the spindle 35 (as shown in FIGS. 4 and 6). As shown in FIGS. 5 and 6, a pulley 48 is attached to one end of the shaft 47' of the compression roller 47.

The compression roller 47 is not uniform in width, but comprises three axial parts 47A, 47B and 47C of approximately equal lengths, two thicker parts 47A and 47C of about the same larger diameter sandwiching the thinner part 47B therebetween of a smaller diameter.

The U-shaped member 46 is for the purpose of convenience not only in the positional adjustment of the compression roller 47 but also in its attachment and removal. This is not an indispensable component, that is, the compression roller 47 may be directly attached to the side walls 42 and 43.

A supply roller 50 and a take-up roller 51 are also rotatably supported between the two side walls 42 and 43 and near their mutually opposite end parts such that their rotary shafts 50' and 51' are parallel to the rotary shaft 47' of the compression roller 47. Another pulley 52 is attached to one end of the rotary shaft 51' of the take-up roller 51 protruding out from the side wall 43, as shown in FIG. 6.

The tape-advancing motor 54 for advancing a tape between the rollers 50 and 51 is attached inside the side wall 43, its rotary shaft 54' penetrating the side wall 43 and having a pulley 55 and a gear 56 attached to its protruding end (in this order from the side wall 43 to the tip). A belt 57 is stretched between this pulley 55 and the pulley 52 on the take-up roller 51 through an intermediate pulley 58 for providing tension to the belt 57 such that the rotary motion of the tape-advancing motor 54 is communicated to the take-up roller 51. It now goes without saying that a set of gears may be used instead of the belt 57 for this purpose.

Figure 6:
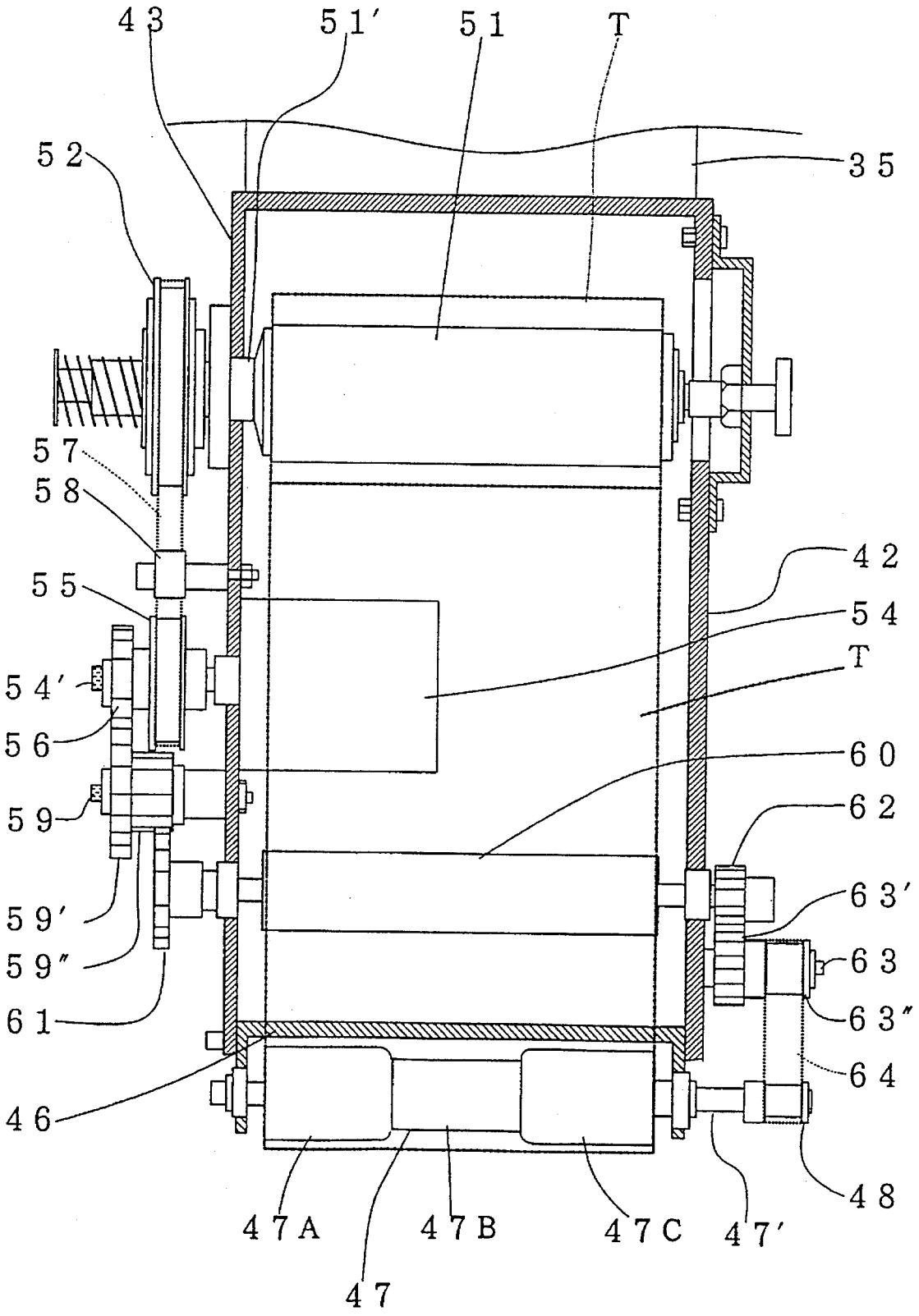
FIG. 6 is a sectional view of the tape-advancing mechanism taken along line 6—6 of FIG. 4.

Although the tape-advancing motor 54 may be placed on the outer side of the side wall 43, it is preferable to set it on the inner side, as shown in FIG. 6, because the tape-advancing mechanism 40 is adapted to rotate.

The tape-advancing motor 54 is connected to lead line B. Power is supplied to the motor 54 through lead line B, the connector 38 and lead line A.

Also supported rotatably between the side walls 42 and 43 is a speed-controlling roller 60 for advancing a polishing tape at a constant speed. The speed-controlling roller 60 is at a position between the take-up roller 51 and the compression roller 47. Both ends of its rotary shaft 60' protrude outward from the side walls 42 and 43 and have gears 61 and 62 attached thereto.

Outside the side wall 43 between the gears 56 and 61, there is a rotatably supported rotary shaft 59, on which are attached an outer gear 59' engaging the gear 56 and an inner gear 59" engaging the gear 61, such that the rotary motion of the tape-advancing motor 54 is communicated through gears 59' and 59" to the speed-controlling roller 60.

Since the rate of rotation of the speed-controlling roller 60 is determined by the numbers of teeth on the gears 56, 59', 59" and 61, the rotational motion of the roller 60, and hence also the speed of travel of the polishing tape can be adjusted by combining gears having appropriate numbers of teeth.

Outside the side wall 42, there is another rotatably supported rotary shaft 63, on which are attached an inner gear 63' on the inner side engaging the gear 62 and a pulley 63' on the outer side. A belt 64 is stretched between this pulley 63' and the pulley 48 on the compression roller 47, as shown in FIG. 5, such that these two rollers 47 and 60 can rotate together. The numbers of teeth on the gears 62 and 63' and the diameters of the pulleys 48 and 63" are determined such that the polishing tape will be caused to travel at the same speed by the rollers 47 and 60.

The reason for this design is that the motion of the polishing tape (including its rotational motion due to the rotation of the spindle) may tend to be obstructed when the tape is pressed against a target object through the compression roller. If the compression roller is directly connected to the motor, the polishing tape can be moved more smoothly even when it is being pressed against a target object. If the polishing tape is only lightly pressed against a target object, for example, it can move smoothly and there is no need to connect both the compression roller 57 and the speed controlling roller 60 to the motor. The speed controlling roller 60 is unnecessary also when there is no need to keep the tape motion uniform.

The polishing tape T, as shown in FIG. 4, is supplied from the supply roller 50 to the compression roller 57 through intermediate rollers 65*a* and 65*b*, and from the compression roller 57 to the take-up roller 45 through the speed-controlling roller 60.

Although a combination of gears and pulleys with belts was used for the transmission of power in the example described above, use may be made exclusively of gears or pulleys with belts.

The manner of using the apparatus for polishing and/or cleaning will be described next.

Let us consider a flat planar target object as shown at 10 in FIG. 2. After it is placed inside the indentation 11 formed in the table 6, the vacuum pump means is activated to create a state of negative pressure such that the target object is secured inside the indentation 11. Next, the cylinder 25 is activated such that the tape-advancing mechanism 40 is lowered together with the attachment device 20 to a specified position. The knob 27 is advanced until the polishing tape T is pressed against the target object 10 with a specified contact pressure. Since the spring 26 exerts a reaction force to the extended section 22', the position of the attachment device 20, and hence also that of the tape-advancing mechanism 40 can be adjusted accurately.

Next, the tape-advancing motor 54 is activated, causing the take-up roller 52 to rotate through the belt 57 and the speed-controlling roller 60 through the gears 59' and 59". The rotary motion of the speed-controling roller 60 is communicated to the compression roller 47 through the gear 63. A new surface of the polishing tape T is thus supplied to the compression roller 47 constantly for polishing and/or cleaning.

The spindle-rotating motor 32 is also activated, thereby causing the spindle 35 to rotate through the belt 37. This causes the tape-advancing mechanism 40 to rotate and to thereby effect a rotary polishing with a constantly fresh supply of the polishing tape.

As shown in FIG. 6, the center part 47B of the compression roller 47 has a smaller diameter than its end parts 47A and 47C. This choice of design is for preventing the polishing tape from becoming twisted or wrinkled during its use. If use is made of a compression roller with a uniform diameter along its entire length and if it is rotated in a horizontal plane around a vertical axis (or the axis of the spindle 35) through its center, while the polishing tape is pressed against the target object all along the roller, the friction force operates evenly through the length of the roller in the direction opposite to the direction of rotation of the roller against the polishing tape. The force of rotation of the roller in the horizontal plane, however, becomes greater proportionally to the distance from the center around which it rotates in a horizontal plane. The effect of the rotary motion of the roller 47 around its own axis (for advancing the tape) is usually negligible. Thus, when the roller is rotated, the force of its rotation becomes greater than the force of friction near its ends where the tape will begin to move, but the two forces may nearly balance each other near its center where the tape tends to stay where it is. This makes it difficult for the roller to rotate, and the polishing tape tends to become twisted and/or wrinkled. In other words, such a compression roller cannot be operated smoothly.

Since the center part 47B of the compression roller 47 is made thinner than the end parts 47A and 47C according to this invention, the polishing tape is not pressed against the target object at the center part of the compression roller 47, and the polishing tape can be rotated smoothly in a horizontal plane. The lengths of the three parts 47A, 47B and 47C of the roller 47 should be determined in principle by the forces of rotation and friction. When the friction force is small, that is, when the granular size of the abrasive on the polishing tape is small, or when the compressive force with which the roller 47 is pressed is weak, the length of the center part 47B may be relatively small. When the force of polishing is strong, on the other hand, the length of the center part 47B must be accordingly increased. Normally, smooth operations are possible if each part 47A, 47B and 47C is about one third of the entire length of the roller 47.

Figure 8A:
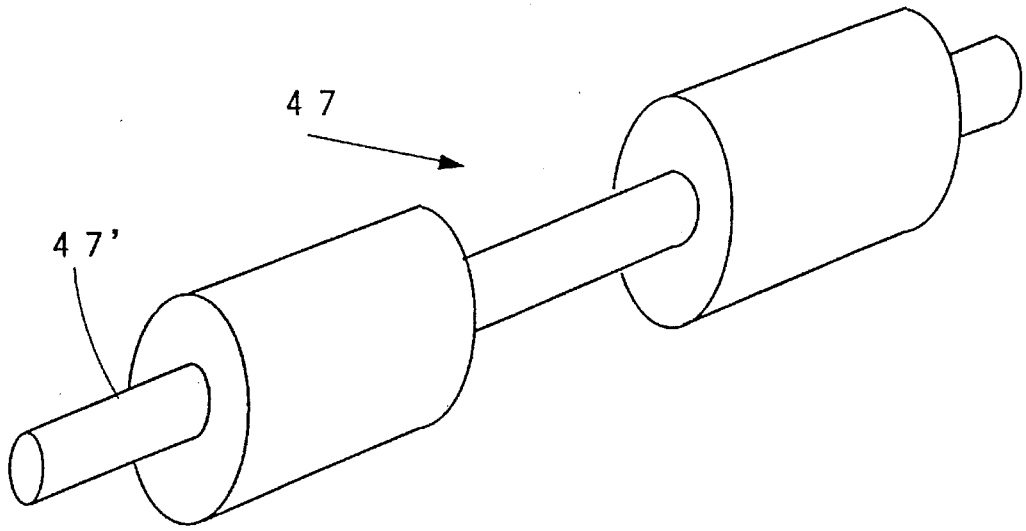
FIGS. 8(*a*) and 8(*b*) are diagonal views of other compression rollers which may be used in the apparatus of FIG. 1.
Figure 8B:
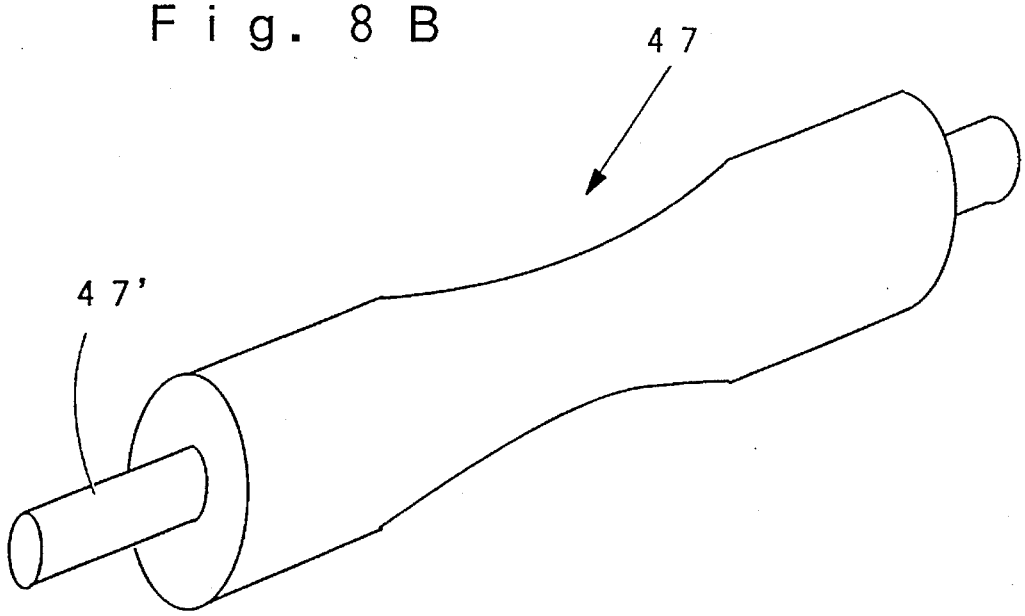

It is only for the reason stated above that the center part 47B of the compression roller 47 is made thinner. Thus, as a variation, the center part 47B may be omitted, as shown in FIG. 8(*a*), leaving only two roller units away from each other connected by a common shaft therebetween. As another variation, the compression roller 47 may be designed so as to have its diameter gradually decreased towards its center, as shown in FIG. 8(*b*).

Next, the shifting mechanism 9 is activated to cause the table 6 to move within a horizontal plane (that is, in the X and Y directions) such that an external surface area of the target object 10 can be evenly polished. The order of activating the motors 32 and 54 and the shifting mechanism 9 need not be as described above. The order may be conveniently changed, depending on each situation.

When the apparatus 1, thus formed, is used for removing contaminants on a liquid crystal substrate (or a cleaning operation), it is preferred that the operation be carried out under the following conditions:

Rotation of the spindle: Up to 300 rpm

Load for the compression: Up to 15 kg

Speed of polishing tape: Up to 150 mm/minute. It is preferred to use a polishing tape with a cushioning property.

Figure 7A:
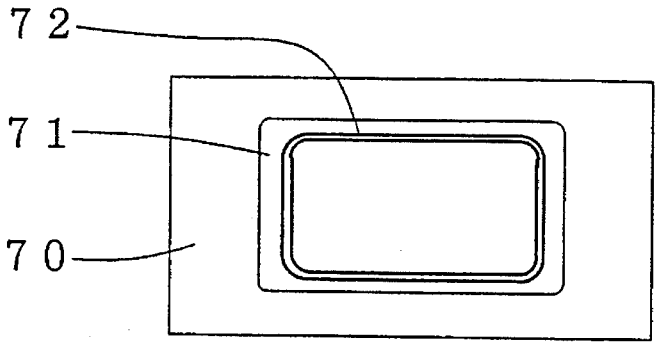
FIG. 7(*a*) is a plan view of another table which may be incorporated into the apparatus of FIG. 1, FIG. 7(*b*) is a sectional side view of the table of FIG. 7(*a*) when a curved planar target object is placed thereon, and FIG. 7(*c*) is another sectional side view of the same table of FIG. 7(*b*) when the target object has been flattened.
Figure 7B:
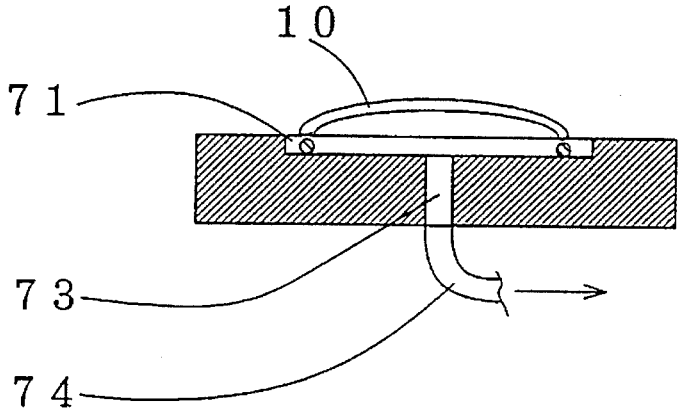
Figure 7C:
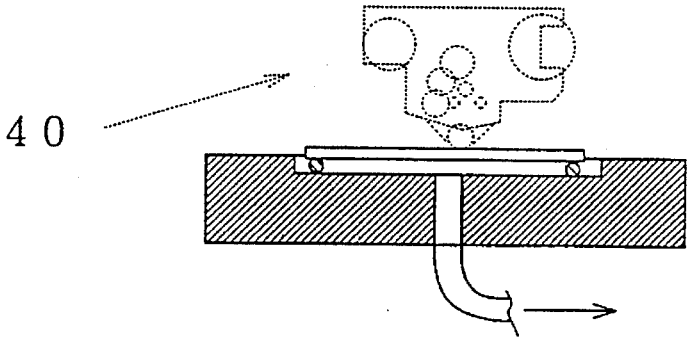

FIGS. 7(*a*), 7(*b*) and 7(*c*) show another table 70 according to another embodiment of this invention which may be incorporated into the apparatus 1 shown above when the target object 10 is of an elastic material and has a convex surface such as a front window pane of an airplane made of an acrylic material. The table 70 according to this embodiment also has an indentation 71 formed at its center, but an elastic packing material 72 is distributed inside and surrounding the area of the indentation 71. A hole 73 opens into the indentation 71 with the other end of the hole 73 attached to a pipe 74 connected to a vacuum pump means, or a vacuum source (not shown), such that the interior of the indentation 71 can be evacuated. For the operation, the curved target object 10 is placed inside the indentation 71 with its convex surface facing upward, as shown in FIG. 7(*b*), and the interior of the indentation is evacuated until the elastic target object 10 becomes flat, as shown in FIG. 7(*c*). A sealed condition is maintained inside the indentation 71 by means of the packing material 72.

After the target object 10 has been flattened, the polishing apparatus 1 is operated as described above for a polishing and/or cleaning process. Thus, even a target object with a curved surface can be efficiently polished and/or cleaned by the use of such a table 70 as shown in FIG. 7.

In summary, a polishing apparatus according to this invention causes a horizontally (longitudinally) advancing polishing tape to rotate around a vertical axis, thereby automating the polishing and/or cleaning process which used to be carried out manually. Thus, objects like liquid crystal glass substrates and printed circuit boards can be polished and/or cleaned efficiently and their production costs can be reduced while their quality can be improved. Since a fresh tape surface is constantly supplied during an operation and the direction of travel of the tape is changed automatically, the polishing and/or cleaning operation can be carried out more efficiently. Since the advancement of the polishing tape and its rotary motion can be effected by means of a relatively simple mechanism, the production cost of the apparatus is low and its maintenance is easy. With a table provided with an elastic packing material and a vacuum source, furthermore, the apparatus according to this invention can operate efficiently even on elastic target objects with a convex surface.

What is claimed is:

1. A polishing apparatus for advancing and rotating a polishing tape, said polishing machine comprising:

a base plate having an opening therethrough;

a spindle rotatably contained in said opening through said base plate;

a first rotating means attached to said base plate for rotating said spindle;

a pair of side walls attached to said spindle;

a compression roller for pressing a polishing tape against a target object, said compression roller being rotatably attached between said side walls, said compression roller having a rotary shaft which is perpendicular to the axis of said spindle, said compression roller having a center part with a smaller diameter than end parts which sandwich said center part;

tape-advancing rollers including a supply roller and a take-up roller both having a rotary shaft which is parallel to the rotary shaft of said compression roller and rotatably supported by said side walls, said supply roller serving to supply said polishing tape and said take-up roller serving to take up said polishing tape supplied from said supply roller; and a second rotating means attached to said spindle for rotating said take-up roller.

2. The polishing apparatus of claim 1 wherein said center part and said end parts of said compression roller are each about one-third of the length of said compression roller.

3. The polishing apparatus of claim 2 further comprising:

a table for placing said target object thereon, said table being placed opposite said compression roller and movable within a plane which is perpendicular to the axial direction of said spindle; and a shifting means for moving said table.

4. The polishing apparatus of claim 3 further comprising a frame; and an attaching means for attaching said base plate to said frame slidably in the axial direction of said spindle, said attaching means including means for moving said base plate and thereby placing said compression roller at a specified position.

5. The polishing apparatus of claim 4 wherein said table has an indentation formed thereon for containing said target object therein, said indentation being adapted to be connected to a vacuum source.

6. The polishing apparatus of claim 5 wherein said table has at least one pin-containing hole which opens to said indentation and contains a pin therein, said pin being capable of pushing said target object out of said indentation.

7. The polishing apparatus of claim 5 wherein said table has an elastic member provided inside and around said indentation.

8. The polishing apparatus of claim 3 wherein said table has an indentation formed thereon for containing said target object therein, said indentation being adapted to be connected to a vacuum source.

9. The polishing apparatus of claim 8 wherein said table has at least one pin-containing hole which opens to said indentation and contains a pin therein, said pin being capable of pushing said target object out of said indentation.

10. The polishing apparatus of claim 8 wherein said table has an elastic member provided inside and around said indentation.

11. The polishing apparatus of claim 1 further comprising:

a table for placing said target object thereon, said table being placed opposite said compression roller and movable within a plane which is perpendicular to the axial direction of said spindle; and a shifting means for moving said table.

12. The polishing apparatus of claim 11 further comprising:

a frame; and an attaching means for attaching said base plate to said frame slidably in the axial direction of said spindle, said attaching means including means for moving said base plate and thereby placing said compression roller at a specified position.

13. The polishing apparatus of claim 12 wherein said table has an indentation formed thereon for containing said target object therein, said indentation being adapted to be connected to a vacuum source.

14. The polishing apparatus of claim 13 wherein said table has at least one pin-containing hole which opens to said indentation and contains a pin therein, said pin being capable of pushing said target object out of said indentation.

15. The polishing apparatus of claim 13 wherein said table has an elastic member provided inside and around said indentation.

16. The polishing apparatus of claim 11 wherein said table has an indentation formed thereon for containing said target object therein, said indentation being adapted to be connected to a vacuum source.

17. The polishing apparatus of claim 16 wherein said table has at least one pin-containing hole which opens to said indentation and contains a pin therein, said pin being capable of pushing said target object out of said indentation.

18. The polishing apparatus of claim 16 wherein said table has an elastic member provided inside and around said indentation.

19. The polishing apparatus of claim 1 wherein said compression roller has two roller units connected by a common shaft therebetween.

20. The polishing apparatus of claim 1 wherein the diameter of said compression roller decreases gradually towards a center thereof.

* * * * *